US008174343B2

(12) United States Patent
Shen

(10) Patent No.: US 8,174,343 B2
(45) Date of Patent: May 8, 2012

(54) ELECTROMECHANICAL RELAY AND METHOD OF MAKING SAME

(75) Inventor: Jun Shen, Phoenix, AZ (US)

(73) Assignee: Magvention (Suzhou) Ltd., Suzhou (CN)

( * ) Notice: Subject to any disclaimer, the term of this patent is extended or adjusted under 35 U.S.C. 154(b) by 0 days.

(21) Appl. No.: 12/748,470

(22) Filed: Mar. 29, 2010

(65) Prior Publication Data

US 2010/0182110 A1 Jul. 22, 2010

Related U.S. Application Data

(63) Continuation-in-part of application No. 11/534,655, filed on Sep. 24, 2006, now Pat. No. 7,482,899.

(60) Provisional application No. 61/165,460, filed on Mar. 31, 2009.

(51) Int. Cl.
*H01H 51/22* (2006.01)
*H01H 9/00* (2006.01)

(52) U.S. Cl. ..... 335/81; 335/78; 335/79; 335/80; 335/85; 335/124; 335/128; 335/177; 335/179; 335/180; 335/181

(58) Field of Classification Search ..... 335/78–86, 335/124, 128, 177–181
See application file for complete search history.

(56) References Cited

U.S. PATENT DOCUMENTS 2,632,072 A * 3/1953 Zellner ..... 335/78
3,906,416 A * 9/1975 Sprando ..... 335/128
4,543,550 A * 9/1985 Sauer ..... 335/78
4,668,928 A * 5/1987 Davis et al. ..... 335/79
5,398,011 A * 3/1995 Kimura et al. ..... 335/79
5,475,353 A * 12/1995 Roshen et al. ..... 335/78
5,818,316 A * 10/1998 Shen et al. ..... 335/78
6,124,650 A * 9/2000 Bishop et al. ..... 310/40 MM
6,469,603 B1 * 10/2002 Ruan et al. ..... 335/78
6,492,887 B1 * 12/2002 Diem et al. ..... 335/78
6,633,158 B1 * 10/2003 Shen et al. ..... 324/207.26
2002/0002771 A1 * 1/2002 Lin et al. ..... 29/602.1
2004/0027218 A1 * 2/2004 Stafford et al. ..... 335/78

* cited by examiner

*Primary Examiner* — Mohamad Musleh

(57) ABSTRACT

A relay comprises a movable body placed in a cavity which is formed on a substrate and surrounded by a spacer layer and sealed by a cover layer. The movable body comprises a first magnet which is permanently magnetized and has at least a first end. A nearby switching electromagnet, when energized, produces a switching magnetic field which is primarily perpendicular to the magnetization direction of the first magnet and exerts a magnetic torque on the first magnet to force the first magnet and said movable body to rotate and close an electrical conduction path at the first end. Changing the direction of the electrical current in the switching electromagnet changes the direction of the switching magnetic field and thus the direction of the magnetic torque on the first magnet, and causes the first magnet and said movable body to rotate in an opposite direction and opens the electrical conduction path at the first end. The first magnet can comprise multiple magnetic layers to form relatively closed magnetic circuits with other magnetic components. Latching and non-latching types of relays can be formed by appropriately using soft and permanent magnets as various components.

20 Claims, 6 Drawing Sheets

Front view.

Top view.

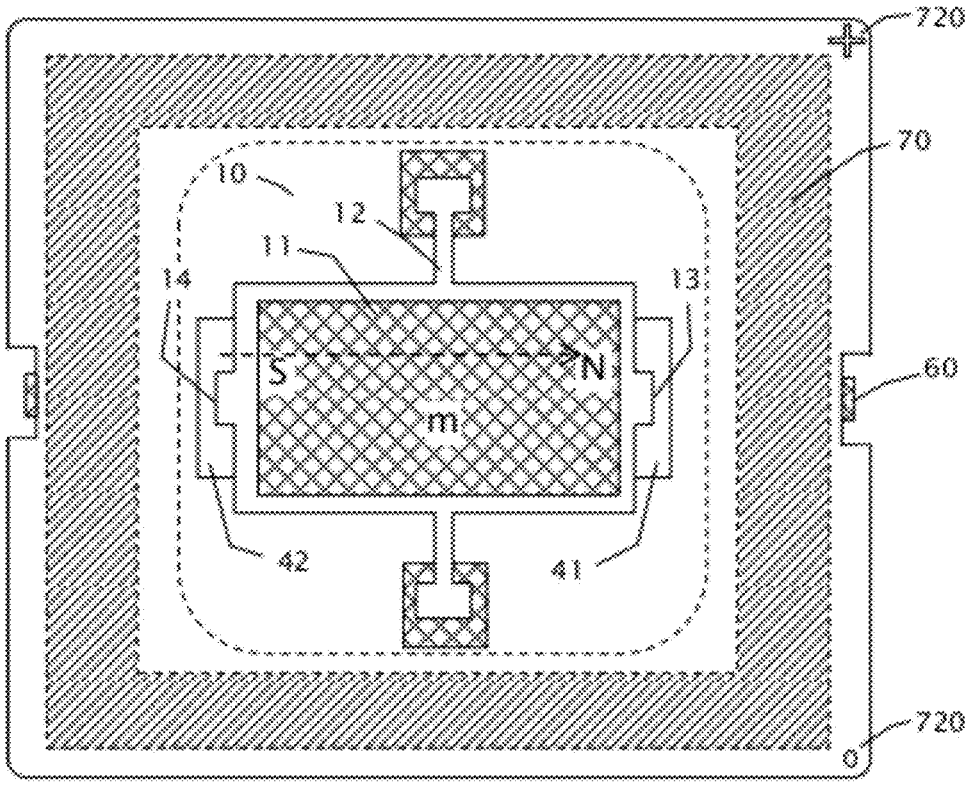
Figure 1B. Top view.
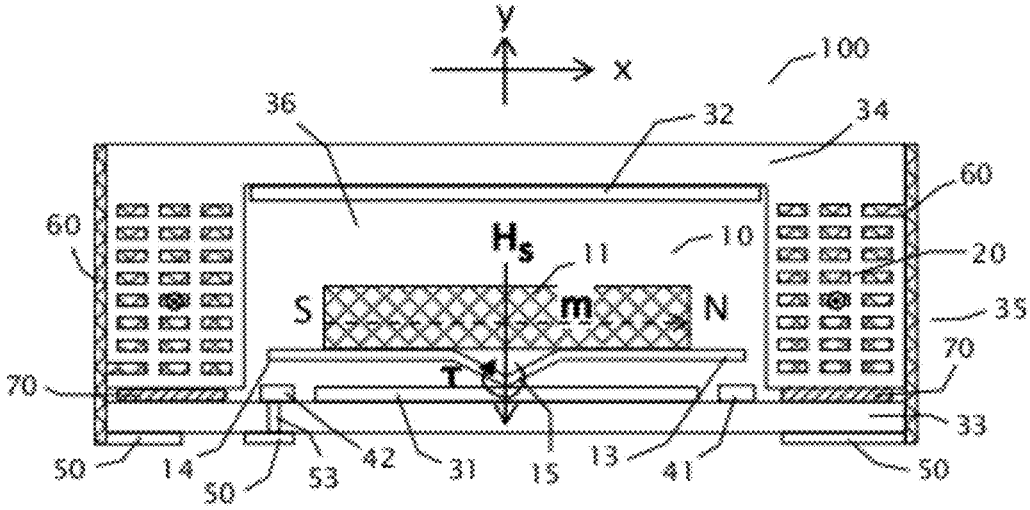
Figure 1A. Front view.

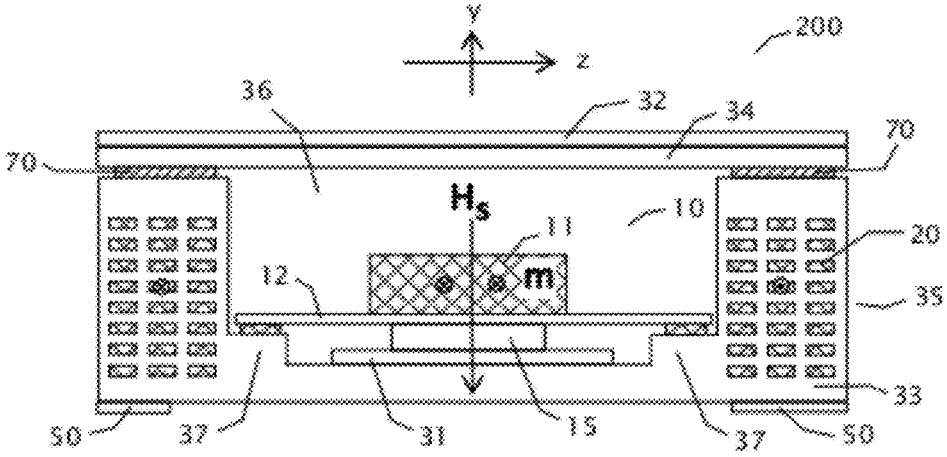
Figure 2B. Side view.
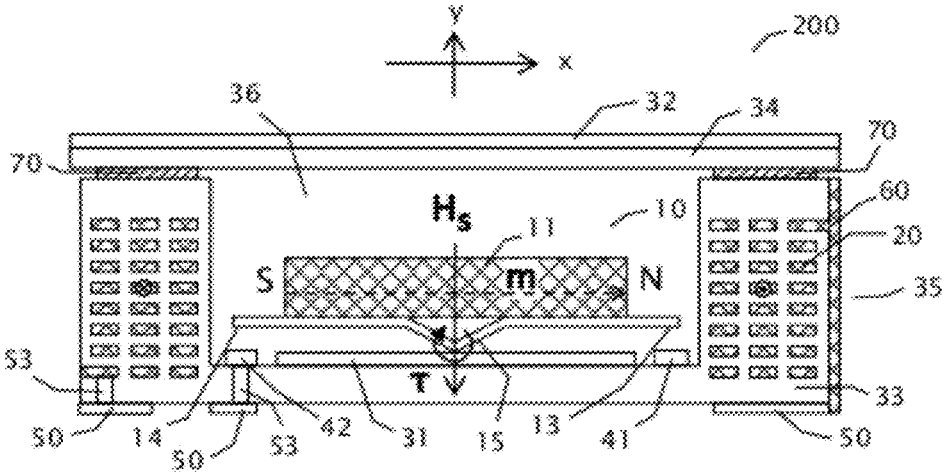
Figure 2A. Front view.
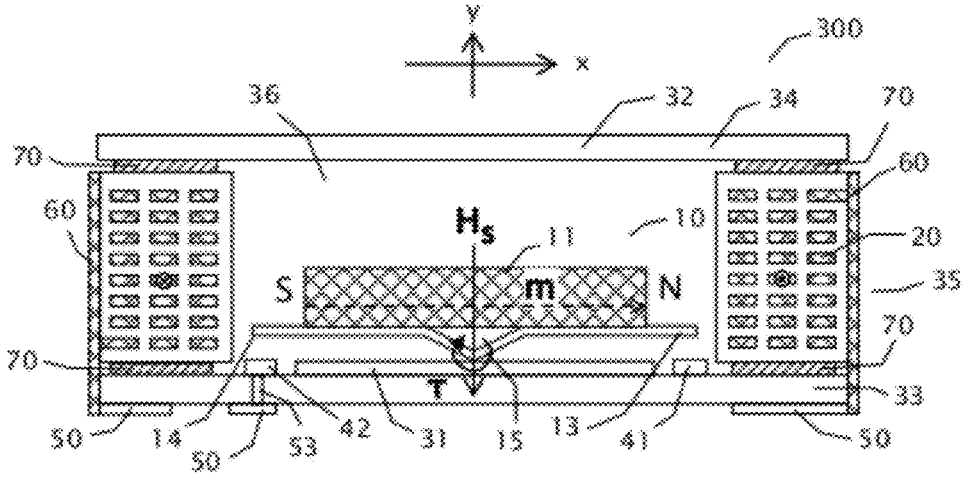
Figure 3. Front view.

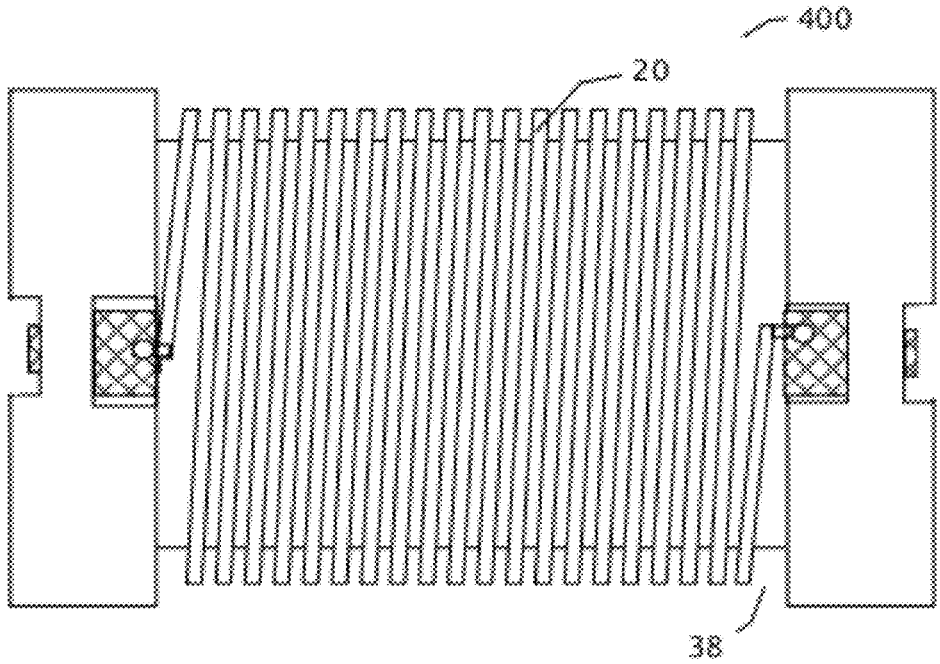
Figure 4B. Top view.
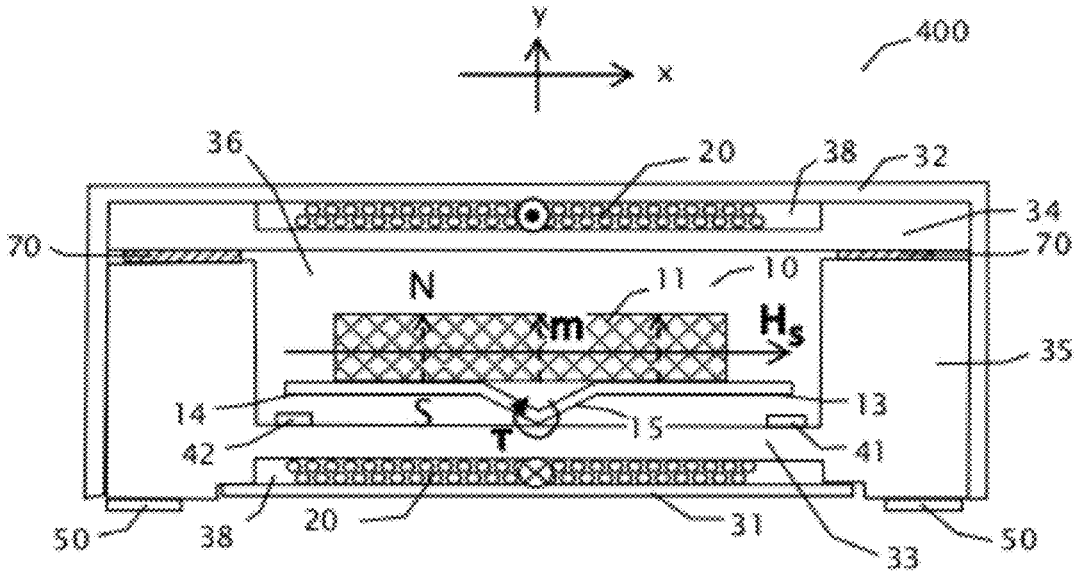
Figure 4A. Front view.

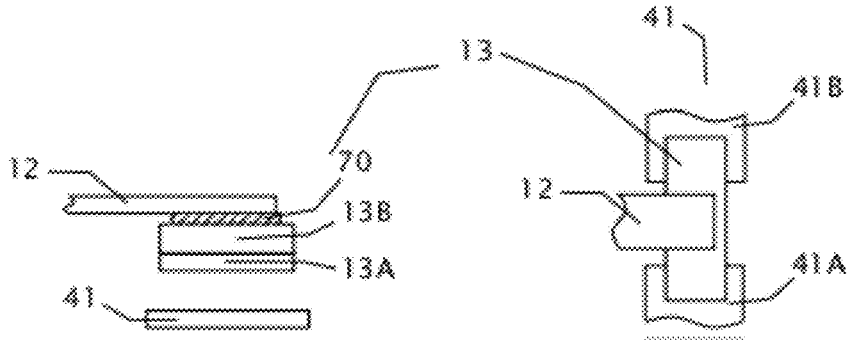
Detailed cross-sectional view of contact 13 area.
Detailed top view of contact 13 area.
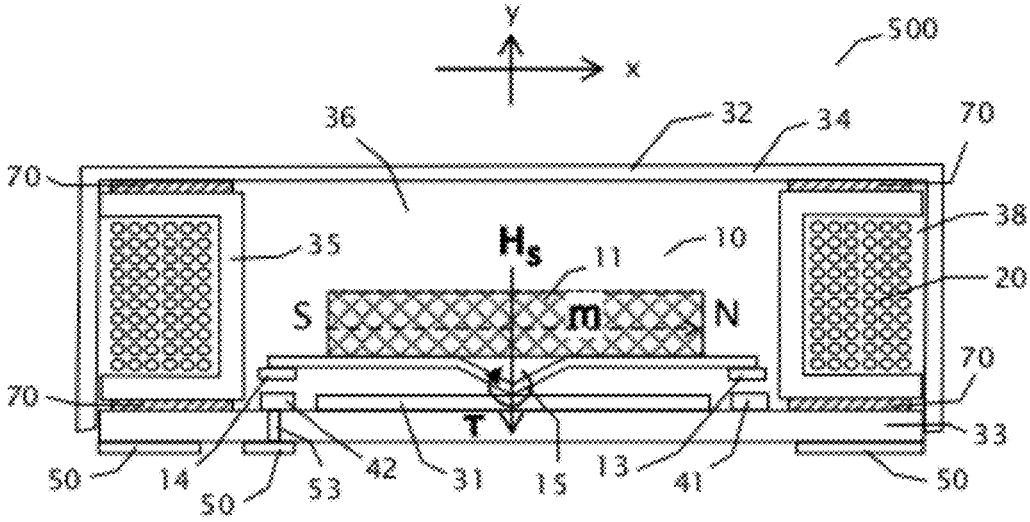
Figure 5. Front view.

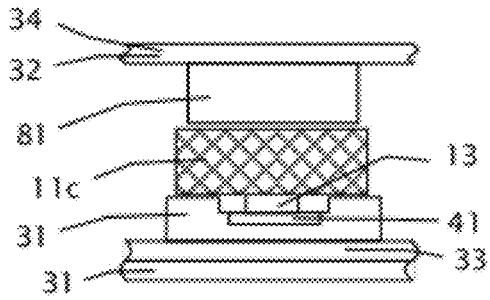
Detailed cross-sectional view (from right side) of contact 13 area.
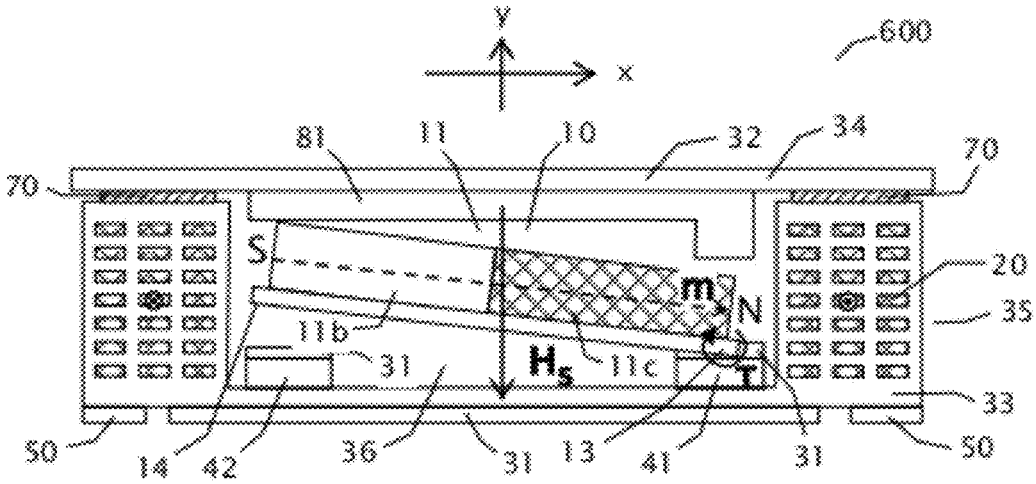
Figure 6. Front view.

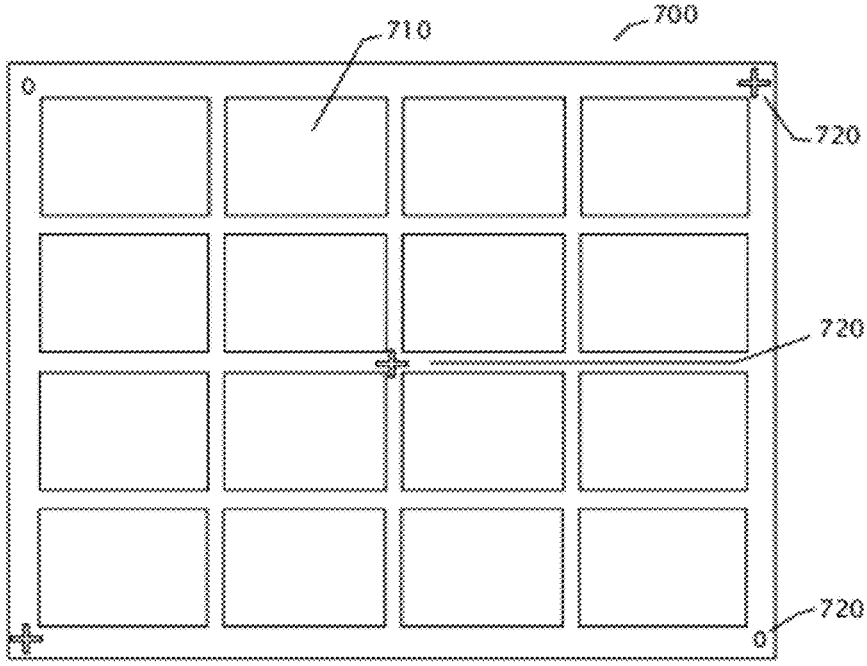
Figure 7A. Top view.
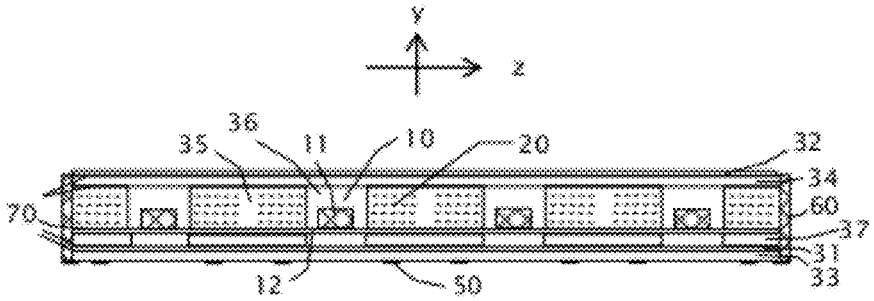
Figure 7B. Side view.
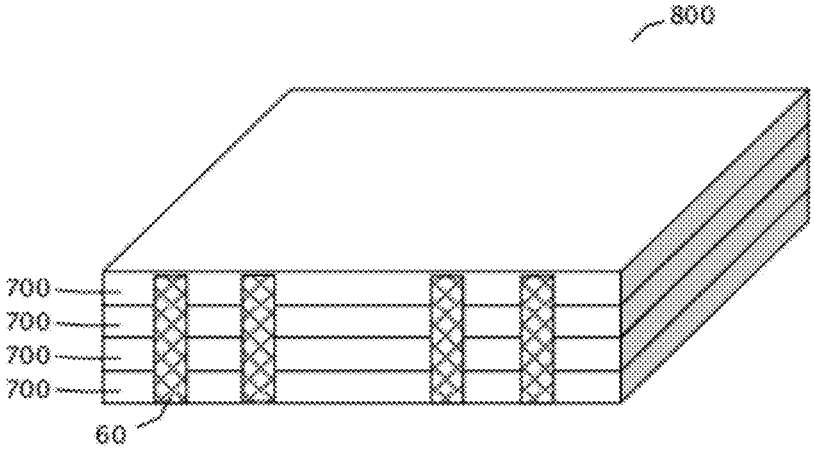
Figure 8. 3-dimensional view.

ELECTROMECHANICAL RELAY AND METHOD OF MAKING SAME

CROSS-REFERENCE TO RELATED APPLICATIONS

This patent application claims the benefit of U.S. Provisional Patent Application Ser. No. 61/165,460, filed on Mar. 31, 2009, which is hereby incorporated by reference. This application is a continuation-in-part of U.S. application Ser. No. 11/534,655, filed on Sep. 24, 2006, now U.S. Pat. No. 7,482,899 B2 issued on Jan. 27, 2009, which is incorporated herein by reference in its entirety.

FIELD OF THE INVENTION

The present invention relates to relays. More specifically, the present invention relates to electromechanical relays and to methods of making electromechanical relays.

BACKGROUND OF THE INVENTION

Relays are electromechanical switches operated by a flow of electricity in one circuit and controlling the flow of electricity in another circuit. A typical relay consists basically of an electromagnet with a soft iron bar, called an armature, held close to it. A movable contact is connected to the armature in such a way that the contact is held in its normal position by a spring. When the electromagnet is energized, it exerts a force on the armature that overcomes the pull of the spring and moves the contact so as to either complete or break a circuit. When the electromagnet is de-energized, the contact returns to its original position. Variations on this mechanism are possible: some relays have multiple contacts; some are encapsulated; some have built-in circuits that delay contact closure after actuation; some, as in early telephone circuits, advance through a series of positions step by step as they are energized and de-energized, and some relays are of latching type.

Relays are classified by their number of poles and number of throws. The pole of a relay is the terminal common to every path. Each position that the pole can connect to is called a throw. A relay can be made of n poles and m throws. For example, a single-pole-single-throw relay (SPST) has one pole and one throw. A single-pole-double-throw (SPDT) relay has one pole and two throws. A double-pole-double-throw (DPDT) relay has two poles, each with two simultaneously controlled throws.

Relays are then classified into forms. Relay forms are categorized by the number of poles and throws as well as the default position of the relay. Three common relay forms are: A, B, and C. Form A relays are SPST with a default state of normally open. Form B relays are SPST with a default state of normally closed. Form C relays are SPDT and break the connection with one throw before making contact with the other (break-before-make).

Latching relays are the types of relays which can maintain closed and open contact positions without energizing an electromagnet. Short current pulses are used to temporally energize the electromagnet and switch the relay from one contact position to the other. An important advantage of latching relays is that they do not consume power (actually they do not need a power supply) in the quiescent state.

Conventional electromechanical relays have traditionally been fabricated one at a time, by either manual or automated processes. The individual relays produced by such an "assembly-line" type process generally have relatively complicated structures and exhibit high unit-to-unit variability and high unit cost. Conventional electromechanical relays are also relatively large when compared to other electronic components. Size becomes an increasing concern as the packaging density of electronic devices continues to increase.

Many designs and configurations have been used to make latching electromechanical relays. Two forms of conventional latching relays are described in the Engineers' Relay Handbook (Page 3-24, Ref. [1]). A permanent magnet supplies flux to either of two permeable paths that can be completed by an armature. To transfer the armature and its associated contacts from one position to the other requires energizing current through the electromagnetic coil using the correct polarity. One drawback of these traditional latching relay designs is that they require the coil to generate a relatively large reversing magnetic field in order to transfer the armature from one position to the other. This requirement mandates a large number of wire windings for the coil, making the coil size large and impossible or very difficult to fabricate other than using conventional winding methods.

A non-volatile programmable switch is described in U.S. Pat. No. 5,818,316 issued to Shen et al. on Oct. 6, 1998, the entirety of which is incorporated herein by reference. The switch disclosed in this reference includes first and second magnetizable conductors having first and second ends, respectively, each of which is a north or south pole. The ends are mounted for relative movement between a first position in which they are in contact and a second position in which they are insulated from each other. The first conductor is permanently magnetized and the second conductor is switchable in response to a magnetic field applied thereto. Programming means are associated with the second conductor for switchably magnetizing the second conductor so that the second end is alternatively a north or south pole. The first and second ends are held in the first position by magnetic attraction and in the second position by magnetic repulsion.

Another latching relay is described in U.S. Pat. No. 6,469,602 B2 issued to Ruan et al. on Oct. 22, 2002 (claiming priority established by the Provisional Application No. 60/155,757, filed on Sep. 23, 1999), the entirety of which is incorporated herein by reference. The relay disclosed in this reference is operated by providing a movable body sensitive to magnetic fields such that the movable body exhibits a first state corresponding to the open state of the relay and a second state corresponding to the closed state of the relay. A first magnetic field may be provided to induce a magnetic torque in the movable body, and the movable body may be switched between the first state and the second state with a second magnetic field that may be generated by, for example, a conductor formed on a substrate with the relay.

Yet another non-volatile micro relay is described in U.S. Pat. No. 6,124,650 issued to Bishop et al. on Sep. 26, 2000, the entirety of which is incorporated herein by reference. The device disclosed in this reference employs square-loop latchable magnetic material having a magnetization direction capable of being changed in response to exposure to an external magnetic field. The magnetic field is created by a conductor assembly. The attractive or repulsive force between the magnetic poles keeps the switch in the closed or open state.

Each of the prior arts, though providing a unique approach to make latching electromechanical relays and possessing some advantages, has some drawbacks and limitations. Some of them may require large current for switching, and some may require precise relative placement of individual components. These drawbacks and limitations can make manufacturing difficult and costly, and hinder their value in practical applications.

Accordingly, it would be highly desirable to provide an easily switchable electromechanical relay which is also simple and easy to manufacture and use.

It is a purpose of the present invention to provide a new and improved method to make such electromechanical relays.

SUMMARY OF THE INVENTION

The above problems and others are at least partially solved and the above purposes and others are realized in a relay comprising a movable body placed in a cavity which is formed on a substrate, surrounded by a spacer layer and sealed by a cover layer. The movable body comprises a first magnet which is permanently magnetized and has at least a first end. A nearby switching electromagnet, when energized, produces a switching magnetic field which is primarily perpendicular to the magnetization direction of the first magnet and exerts a magnetic torque on the first magnet to force the first magnet and said movable body to rotate and closes an electrical conduction path at the first end. Changing the direction of the electrical current in the switching electromagnet changes the direction of the switching magnetic field and thus the direction of the magnetic torque on the first magnet, and causes the first magnet to rotate in an opposite direction and opens the electrical conduction path at the first end. The first magnet can comprise multiple magnetic layers to form relatively closed magnetic circuits with other magnetic components. Latching and non-latching types of relays can be formed by appropriately using soft and permanent magnets as various components.

BRIEF DESCRIPTION OF THE FIGURES

The above and other features and advantages of the present invention are hereinafter described in the following detailed description of illustrative embodiments to be read in conjunction with the accompanying figures, wherein like reference numerals are used to identify the same or similar parts in the similar views, and:

FIG. 1A is a front view of an exemplary embodiment of an electromechanical relay;

FIG. 1B is a top view of the electromechanical relay (with inside revealed);

FIG. 2A is a front view of another exemplary embodiment of an electromechanical relay;

FIG. 2B is a side view of the electromechanical relay;

FIG. 3 is a front view of another exemplary embodiment of an electromechanical relay;

FIG. 4A is a front view of another exemplary embodiment of an electromechanical relay;

FIG. 4B is a top view of the electromechanical relay (soft magnetic layer 32 not shown);

FIG. 5 is a front view of another exemplary embodiment of an electromechanical relay, with detailed illustrations in the contact 13 area;

FIG. 6 is a front view of another exemplary embodiment of an electromechanical relay, with detailed illustrations in the contact 13 area;

FIG. 7A is a top view of an exemplary embodiment of a set of plural electromechanical relays.

FIG. 7B is a side view of the exemplary embodiment of the set of plural electromechanical relays.

FIG. 8 is a 3-dimensional view of an exemplary embodiment of a cube of plural electromechanical relays.

DETAILED DESCRIPTION OF EXEMPLARY EMBODIMENTS

It should be appreciated that the particular implementations shown and described herein are examples of the invention and are not intended to otherwise limit the scope of the present invention in any way. Indeed, for the sake of brevity, conventional electronics, manufacturing, and other functional aspects of the systems (and components of the individual operating components of the systems) may not be described in detail herein. Furthermore, for purposes of brevity, the invention is frequently described herein as pertaining to an electromagnetic relay for use in electrical or electronic systems. It should be appreciated that many other manufacturing techniques could be used to create the relays described herein, and that the techniques described herein could be used in mechanical relays, optical switches, fluidic control systems, or any other switching devices. Further, the techniques would be suitable for application in electrical systems, optical systems, consumer electronics, industrial electronics, wireless systems, space applications, fluidic control systems, medical systems, or any other application. Moreover, it should be understood that the spatial descriptions made herein are for purposes of illustration only, and that practical latching relays may be spatially arranged in any orientation or manner. Arrays of these relays can also be formed by connecting them in appropriate ways and with appropriate devices.

FIGS. 1A and 1B show front and top views, respectively, of an electromechanical relay. With reference to FIGS. 1A and 1B, an exemplary electromechanical relay 100 suitably comprises a movable body 10 placed in a cavity 36, a coil 20, soft magnetic layers 31 and 32, electrical contacts 41 and 42, and a substrate 33. Cavity 36 is formed on substrate 33, surrounded by spacer 35 and sealed by cover 34.

Movable body 10 comprises a first magnet 11, flexure spring and support 12, and electrical contacts 13 and 14. Movable body 10 is further supported by a pivot 15. First magnet 11 comprises a permanent (hard) magnetic layer and is permanently magnetized primarily along the positive x-axis when said first magnet 11 lies leveled. Other magnetization orientation of first magnet 11 is also possible as long as it achieves the function and purpose of this invention. Movable body 10 has a first (right) end associated with the first (right) end of first magnet 11 and contact 13, and has a second (left) end associated with the second (left) end of first magnet 11 and contact 14. Said permanent (hard) magnetic layer can be any type of hard magnetic material that can retain a remnant magnetization in the absence of an external magnetic field and its remnant magnetization cannot be easily demagnetized. In an exemplary embodiment, said permanent magnetic layer is a SmCo permanent magnet with an approximate remnant magnetization ($B_r=\mu_0 M$) of about 1 T predominantly along the positive x-axis when it lies leveled. Other possible hard magnetic materials are, for example, NdFeB, AlNiCo, Ceramic magnets (made of Barium and Strontium Ferrite), CoPtP alloy, and others, that can maintain a remnant magnetization ($B_r=\mu_0 M$) from about 0.001 T (10 Gauss) to above 1 T ($10^4$ Gauss), with coercivity ($H_c$) from about $7.96\times 10^2$ A/m (10 Oe) to above $7.96\times 10^5$ A/m ($10^4$ Oe). First magnet 11 has a combined magnetic moment m predominantly along the positive x-axis when first magnet 11 lies leveled. Flexure spring and support 12 can be any flexible material that on one hand supports movable body 10 and on the other allows movable body 10 to be able to move and rotate. Flexure spring and support 12 can be made of metal layers (such as Beryllium Copper, Ni, NiFe, stainless steel, etc.), or non-metal layers (such as polyimide, Si, $Si_3Ni_4$, etc.). The flexibility of the flexure spring 12 can be adjusted by its thickness, width, length, shape, and elasticity, etc. Pivot 15 further supports movable body 10 to maintain a gap between movable body 10 and substrate 33. Pivot 15 can be placed on the top of movable body 10 to maintain a gap between movable body 10 and soft magnetic layer 32. Electrical contacts 13 and 14 can be any electrically conducting layer such as Au, Ag, Rh, Ru, Pd, AgCdO, Tungsten, etc., or suitable alloys. Electrical contacts 13 and 14 can be formed onto the tips (ends) of movable body 10 by electroplating, deposition, soldering, welding, lamination, screen printing, melting, evaporation, or any other suitable means. Flexure spring and support 12 and electrical contacts 13 and 14 can be formed by either using one process and the same material, or by using multiple processes, multiple layers, and different materials. When movable body 10 rotates and its two ends move up or down, electrical contact 13 (or 14) either makes or breaks the electrical connection with the bottom contact 41 (or 42). Optional insulating layers (not shown) can be placed between the conducting layers to isolate electrical signals in some cases.

Coil 20 (switching electromagnet) is formed by having multiple windings of conducting wires around movable body 10. The conducting wires can be any conducting materials such as Cu, Al, Au, Ag, or others. The windings can be formed by either winding the conducting wires around a bobbin, or by electroplating, deposition, screen printing, etching, laser forming, or other means used in electronics industry (e.g., semiconductor integrated circuits, printed circuit boards, multi-layer ceramic electronic devices, etc.). One purpose of coil 20 in relay 100, when energized, is to provide a switching vertical (along y-axis) magnetic field ($H_s$) so that a magnetic torque ($\tau=\mu_0 m \times H_s$) can be created on movable body 10. Because the magnetic moment m in first magnet 11 is fixed, the direction and magnitude of the torque depends on the direction and magnitude of the current in coil 20. This arrangement provides a means for external electronic control of the relay switching between different states, as to be explained in detail below.

Soft magnetic layers 31 (second magnet) and 32 can be any magnetic material which has high permeability (e.g., from about 100 to above $10^5$) and can easily be magnetized by the influence of an external magnetic field. Examples of these soft magnetic materials include permalloy (NiFe alloys), Iron, Silicon Steels, FeCo alloys, soft ferrites, etc. One purpose of soft magnetic layers 31 and 32 is to form a closed magnetic circuit and enhance the coil-induced magnetic flux density (switching vertical magnetic field $H_s$) in the movable body region. Another purpose of soft magnetic layers 31 and 32 is to cause an attractive force between a pole of first magnetic layer 11 and the induced local opposite magnetic pole of the soft magnetic layer so that a stable contact force can be maintained between electrical contact 13 (or 14) and electrical contact 41 (or 42) when the latching feature is desired. Yet another purpose of soft magnetic layers 31 and 32 is to confine the magnetic field inside cavity 36 enclosed by soft magnetic layers 31 and 32 so that the magnetic interference between adjacent devices can be eliminated or reduced. The distance between soft magnetic layer 31 (or 32) and first magnet 11 can be adjusted to alter the attractive force between the magnetic poles of magnet 11 and the soft magnetic layer 31 (or 32). Openings can also be suitably formed in soft magnetic layers 31 and 32 to achieve the same purpose.

Electrical contacts 41 and 42 can be any electrically conducting layer such as Au, Ag, Rh, Ru, Pd, AgCdO, Tungsten, etc., or suitable alloys. Electrical contacts 41 and 42 can be formed on substrate 33 by electroplating, deposition, screen printing, welding, lamination, melting, evaporation, firing, or any other suitable means. Optional insulating layers (not shown) can be placed between the conducting layers to isolate electrical signals in some cases. Transmission-line types of contacts and metal traces can also be suitably designed and formed for high performance radio-frequency applications.

Substrate 33 can be any suitable structural material (plastic, ceramics, semiconductors, metal coated with thin films, glass, etc.).

Spacer 35 can be any suitable structural material (plastic, ceramics, semiconductors, metal coated with thin films, glass, etc.). Spacer 35 is provided so that cavity 36 can be formed to house movable body 10. Spacer 35 can be formed as a single layer together with coil 20 as shown, or as a separate layer. In this exemplary embodiment, multiple layers of metal traces are printed on a dielectric layer (e.g., ceramic material) and stacked together and co-fired to form coil 20 and spacer 35. The metal traces on adjacent layers are joined from head to tail so that current can flow in a consistent manner (either all clockwise or all counterclockwise).

Cover 34 can be any suitable structural material (plastic, ceramics, semiconductors, metal, glass, etc.) and is provided to seal cavity 36 and to protect movable body 10 and various electrical contacts from outside environment. In this exemplary embodiment (relay 100), cover 34 is formed together with coil 20 and spacer 35 as a unitary body.

Adhesion layer 70 can be any suitable material (glue, epoxy, glass frit, solder, melted metal, paste, etc.) which bonds two interfaces together so that two bodies can be joined. Adhesion layer 70 can be pre-formed on the surfaces of the joining bodies or applied as an individual layer between the two joining interfaces. To promote strong adhesion, a physical (heat, pressure, etc.) or chemical (cross-link, etc.) process is caused to occur in adhesion layer 70 when forming the bond.

Via 53 can be any suitable conducting material (Au, Ag, Cu, Pd, Pt, Tungsten, Al, etc.) which is formed in some openings through various layers (e.g., substrate 33, coil 20, cover 34, etc.) to facilitate electrical connection between metal pads on different surfaces.

Side trace 60 can be any suitable conducting material (Au, Ag, Cu, Pd, Pt, Tungsten, Al, etc.) which is formed on the sides of relay 100 to facilitate electrical connection between metal pads on different surfaces.

Pad 50 can be any suitable conducting material (Au, Ag, Cu, Pd, Pt, Tungsten, Al, etc.) which is formed on the outside surface of relay 100 to serve as electrical terminals. Pad 50 can be coated with suitable soldering material to facilitate soldering on a printed circuit board.

Alignment features 720 (fiducial marks or registration holes) are placed on various layers for alignment purposes during assembly.

In a broad aspect of the invention, an electromagnet 20, when energized, produces a switching magnetic field which is primarily perpendicular to the magnetization direction of first movable magnet 11 and exerts a magnetic torque on first magnet 11 to force first magnet 11 and movable body 10 to rotate and close an electrical conduction path at one end (e.g., first end) of movable body 10. Changing the direction of the electrical current in switching electromagnet 20 changes the direction of the switching magnetic field and thus the direction of the magnetic torque on first magnet 11, and causes first magnet 11 and movable body 10 to rotate in an opposite direction and opens the electrical conduction path at the end (e.g., first end) of movable body 10 and closes the electrical conduction path at the other end (e.g., second end).

With continued reference to FIGS. 1A and 1B, first magnet 11 is permanently magnetized horizontally (along positive x-axis) with a combined magnetization moment m. Movable body 10 can have three basic stable positions: (a) the first (right) end down; (b) the second (left) end down; and (c)

neutral (approximately leveled) position (as shown). When a current passes through coil 20 (switching electromagnet) as shown in FIG. 1A going into (circle with a cross) the paper on the left side and out (circle with a dot) from the paper on the right), a perpendicular switching magnetic field ($H_s$, the solid line with an arrow pointing downward in this case) about first magnet 11 is produced. The switching magnetic field $H_s$ interacts with first magnet 11 and exerts a magnetic torque ($\tau=\mu_0 m \times H_s$) on first magnet 11 and causes first magnet 11 and movable body 10 to rotate clockwise until contact 13 touches contact 41 on the right-hand side, closing the electrical conduction path between contact 13 and contact 41. On the other hand, when the direction of the current in coil 20 is opposite to the direction shown in FIGS. 1A, the magnetic torque ($\tau$) on first magnet 11 is counterclockwise and causes first magnet 11 and movable body 10 to rotate counterclockwise until contact 14 touches contact 42 on the left-hand side, closing the electrical conduction path between contact 14 and contact 42 and opening the electrical conduction path between contact 13 and contact 41. Soft magnetic layers 31 and 32 are placed respectively below and above first magnet 11 to form a closed magnetic circuit and enhance the coil-induced magnetic flux density (switching vertical magnetic field) in movable body 10 region. When electromagnet 20 is not energized, movable body 10 can be in the neutral (leveled) position and maintained in that position by the restoring spring force of spring and support 12 and pivot 15, or remained in one of the tilted states (one end down) when the magnetic attraction between first magnet 11 and soft magnetic layers 31 and 32 is strong enough to hold it there.

FIGS. 2A and 2B show front and side views, respectively, of another electromechanical relay. With reference to FIGS. 2A and 2B, an exemplary electromechanical relay 200 suitably comprises a movable body 10 placed in a cavity 36, a coil 20, soft magnetic layers 31 and 32, electrical contacts 41 and 42, a substrate 33, and other components similar to relay 100. Cavity 36 is formed on substrate 33, surrounded by spacer 35 and sealed by cover 34. In this exemplary embodiment (relay 200), substrate 33, coil 20, and spacer 35 are formed together as a unitary body to form cavity 36. Cavity 36 is sealed with cover 34 after movable body 10 is placed inside. Stage 37 is provided for the attachment of spring 12.

FIG. 3 shows the front view of another exemplary embodiment of electromechanical relay. With reference to FIG. 3, an exemplary electromechanical relay 300 suitably comprises a movable body 10 placed in a cavity 36, a coil 20, soft magnetic layers 31 and 32, electrical contacts 41 and 42, a substrate 33 and other components similar to relay 100. Cavity 36 is formed on substrate 33, surrounded by spacer 35 and sealed by cover 34. In this exemplary embodiment (relay 300), cover 34 is also a soft magnetic layer 32.

FIGS. 4A and 4B show front and top views, respectively, of another exemplary embodiment of electromechanical relay. With reference to FIGS. 4A and 4B, an exemplary electromechanical relay 400 suitably comprises a movable body 10 placed in a cavity 36, a coil 20, soft magnetic layers 31 and 32, electrical contacts 41 and 42, a substrate 33, and other components similar to relay 100. Cavity 36 is formed on substrate 33, surrounded by spacer 35 and sealed by cover 34. In this exemplary embodiment (relay 400), substrate 33 and spacer 35 are formed together as a unitary body to form cavity 36. Cavity 36 is sealed with cover 34 after movable body 10 is placed inside. A recess feature 38 is provided for winding coil 20. First magnet 11 is permanently magnetized along the positive y-axis with a combined magnetic moment m. Coil 20 (switching electromagnet), when energized, produces a switching magnetic field ($H_s$) which is primarily perpendicular to the magnetization direction of first magnet 11, and exerts a torque ($\tau=\mu_0 m \times H_s$) on first magnet 11 and movable body 10 to force first magnet 11 and movable body 10 to rotate and close an electrical conduction path at one end (e.g., first end) of movable body 10. Changing the direction of the electrical current in switching electromagnet 20 changes the direction of the switching magnetic field and thus the direction of the magnetic torque on first magnet 11, and causes first magnet 11 and movable body 10 to rotate in an opposite direction and opens the electrical conduction path at the end (e.g., first end) of movable body 10 and closes the electrical conduction path at the other end (e.g., second end).

FIG. 5 shows the front view of another exemplary embodiment of electromechanical relay. With reference to FIG. 5, an exemplary electromechanical relay 500 suitably comprises a movable body 10 placed in a cavity 36, a coil 20, soft magnetic layers 31 and 32, electrical contacts 41 and 42, a substrate 33, and other components similar to relay 100. Cavity 36 is formed on substrate 33, surrounded by spacer 35 and sealed by cover 34. In this exemplary embodiment (relay 500), spacer 35 also serves as a frame (or bobbin) for coil 20 for winding coil wires in recess 38. Cavity 36 is sealed with cover 34 after movable body 10 is placed inside. Soft magnetic layer 32 also serves as cover 34. In this embodiment, bottom contact 41 has a split configuration (with contact 41A and contact 41B shown in the upper detailed illustrations in FIG. 5) wherein top contact 13 connects 41A and 41B when the first end (right end) of movable body 10 moves toward substrate 33. Contact 13 has an insulating dielectric layer 13B (e.g., a ceramic layer) which electrically isolates the metal contact layer 13A from spring 12. An adhesion layer 70 bonds the metal layer and dielectric layers together.

FIG. 6 shows another exemplary embodiment of electromechanical relay. With reference to FIG. 6, an exemplary electromechanical relay 600 suitably comprises a movable body 10 placed in a cavity 36, a coil 20, soft magnetic layers 31 and 32, electrical contacts 41 and 42, a substrate 33, a stopper 81, and some other components similar to relay 100. Cavity 36 is formed on substrate 33, surrounded by spacer 35 and sealed by cover 34. In this exemplary embodiment (relay 600), soft magnetic layer 32 also serves as cover 34. Movable body 10 comprises a first magnet 11, electrical contacts 13 and 14. First magnet 11 comprises a permanent (hard) magnetic layer 11*c* and a soft magnetic layer 11*b* and is permanently magnetized primarily along the positive x-axis when said first magnet 11 lies leveled. Electrical contacts 13 and 14 are electrically connected. Movable body 10 has a first end (right end) associated with contact 13 and contact 41, and a second end (left end) associated with contact 14 and contact 42. Contact 13 and contact 41 are always in contact due to a strong magnetic attraction force between first magnet 11 and soft magnetic layer 31 at the first end of movable body 10. The second end (left end) of movable body 10 can move up or down when movable body 10 rotates around a rotational axis at the first end (right end). When the second end of movable body 10 moves down, contact 14 and contact 42 are connected so that a closed electrical conduction path is formed between contact 41 and contact 42 vie contact 13 and contact 14. When the second end of movable body 10 moves up, said electrical conduction path between contact 41 and contact 42 is open. A current passing coil 20 produces a switching magnetic field ($H_s$) which in turn exerts a torque ($\tau$) on first magnet 11 and causes first magnet 11 and movable body 10 to rotate. Changing direction of coil current changes direction of the torque, and can cause first magnet 11 and movable body 10 to rotate clockwise or counterclockwise, opening or closing said electrical conduction path between contact 41 and contact 42.

Stopper 81 can be a non-magnetic layer which on one hand prevents the first end of movable body from inadvertently moving up and on the other hand maintains a minimum spacing between first magnet 11 and soft magnetic layer 32. Soft magnetic layer 31 near either end of movable body 10 has a "U" shape (illustrated in the detailed cross-sectional view) in order to achieve a closer distance between first magnet 11 and soft magnetic layer 31 at the corresponding end. Part of soft magnetic layer 31 can also be placed on the side walls of cavity 36 to hold first end of first magnet 11 in place. Alternatively, first end of first magnet 11 can be placed closer to soft magnetic layer 32 and be held in place by soft magnetic layer 32.

FIGS. 7A and 7B show a top view and a side view of an exemplary embodiment of a set of plural electromechanical relays. With reference to FIG. 7, a relay set 700 comprises a plural electromechanical relays 710 on a single substrate 33. Each relay 710 comprises a movable body 10 placed in a cavity 36, a coil 20, soft magnetic layers 31 and 32, electrical contacts 41 and 42, and other components similar to relay 100. Relay 710 can have components and features mentioned in the aforementioned exemplary embodiments. Alignment features 720 (e.g., fiducial marks or registration holes, etc.) are placed on various layers for alignment purposes during assembly. Sheets of spring 12, soft magnetic layers 31 and 32 are placed between various structural layers (substrate 33, stage 37, spacer 35, and cover 34) with adhesion layers 70 to facilitate bonding.

FIG. 8 shows a 3-dimensional view of an exemplary embodiment of a plural electromechanical relays. With reference to FIG. 8, a relay cube 800 comprises a plural electromechanical relay set 700 on a single substrate 33. Side electrical traces 60 can be formed to connect electrical contacts and pads at different layers.

Many methods can be used to make aforementioned exemplary relays. A few examples are provided below.

Example 1

With reference to FIGS. 2A and 2B, substrate 33, coil 20, spacer 35, stage 37, and electrical contacts 41 and 42, pad 50, and via 53 are made into a unitary ceramic body with typical multi-layer co-fired ceramic processes. Coils 20 and other metal contacts and traces can be applied onto ceramic sheets with screen printing. Coil 20 can be formed by printing planar circulating conductor traces on ceramic sheets and connecting head to tail of adjacent sheets of the conductor traces such that the switching coil current flows in a common circular direction. Cavity 36 and stage 37 can be formed by cutting out suitable regions in the corresponding ceramic sheets. Ceramic sheets are then aligned, stacked and pressed together, and then co-fired to form a rigid structure. A soft magnetic layer 31 is placed on the bottom of cavity 36. First magnet 11 is affixed (by welding or using adhesives) to spring 12 to form movable body 10 with suitable contacts formed at the ends. Movable body 10 is placed into cavity 36 with spring 12 bonded to stage 37. Then cavity 36 is sealed with cover 34 with adhesive layer 70. Soft magnetic layer 32 is glued to cover 34. First magnet 11 is then magnetized to the specified orientation and strength.

Example 2

With reference to FIG. 5, stage 37, electrical contacts 41 and 42, pad 50, and via 53 are formed on a ceramic substrate 33 with typical multi-layer co-fired ceramic processes. Coils 20 are formed by winding conducting wires around an insulating spacer layer 35, and then glued to substrate 33. A soft magnetic layer 31 is affixed to the bottom of cavity 36. First magnet 11 is affixed (by welding or using adhesives) to spring 12 to form movable body 10 with suitable contacts formed at the ends. Movable body 10 is placed into cavity 36 with spring 12 bonded to stage 37. Then cavity 36 is sealed by cover 34 with adhesive layer 70. In this case, cover 34 is made of soft magnetic material. First magnet 11 is then magnetized to the specified orientation and strength.

Example 3

With reference to FIGS. 7A and 7B, stage 37, electrical contacts 41 and 42, pad 50, and via 53 are formed on a ceramic substrate 33 with typical multi-layer co-fired ceramic processes. Soft magnetic layer 31 is glued to substrate 33. Spring 12 (with first magnet 11 pre-affixed to it) is glued to stage 37. Coils 20 are formed by screen printing metal traces on ceramic tapes and multiple layers of screen printed ceramic tapes are aligned, stacked and pressed together, and then co-fired. Coil 20 is glued to spring 12. Cover 34 is glued to coil 20. Soft magnetic layer 32 is glued to cover 34. Adhesive layer 70 is used between various layers to facilitate bonding.

It is understood that a variety of methods can be used to fabricate the electromechanical relay. These methods include, but not limited to, semiconductor integrated circuit fabrication methods, printed circuit board fabrication methods, micro-machining methods, co-fired ceramic processes, and so on. The methods include processes such as photo lithography for pattern definition, deposition, plating, screen printing, etching, lamination, molding, welding, adhering, bonding, and so on. The detailed descriptions of various possible fabrication methods are omitted here for brevity.

It will be understood that many other embodiments and combinations of different choices of materials and arrangements could be formulated without departing from the scope of the invention. Similarly, various topographies and geometries of the electromechanical relay could be formulated by varying the layout of the various components.

The corresponding structures, materials, acts and equivalents of all elements in the claims below are intended to include any structure, material or acts for performing the functions in combination with other claimed elements as specifically claimed. Moreover, the steps recited in any method claims may be executed in any order. The scope of the invention should be determined by the appended claims and their legal equivalents, rather than by the examples given above.

REFERENCE

[1] Engineers' Relay Handbook, 5th Edition, published by National Association of Relay Manufacturers, 1996.
[2] U.S. Pat. No. 5,818,316, Shen et al.
[3] U.S. Pat. No. 6,469,602 B2, Ruan and Shen.
[4] U.S. Pat. No. 6,124,650, Bishop et al.
[5] U.S. Pat. No. 6,469,603 B1, Ruan and Shen.
[6] U.S. Pat. No. 5,398,011, Kimura et al.
[7] U.S. Pat. No. 5,847,631, Taylor and Allen.
[8] U.S. Pat. No. 6,094,116, Tai et al.
[9] U.S. Pat. No. 6,084,281, Fullin et al.
[10] U.S. Pat. No. 5,475,353, Roshen et al.
[11] U.S. Pat. No. 5,703,550, Pawlak et al.
[12] U.S. Pat. No. 5,945,898, Judy et al.
[13] U.S. Pat. No. 6,143,997, Feng et al.
[14] U.S. Pat. No. 6,794,965 B2, Shen et al.
[15] U.S. Pat. No. 7,482,899 B2.

What is claimed is:

1. An electromechanical relay, comprising:

a substrate, wherein said substrate comprising a first stationary contact;

a cavity formed on said substrate and surrounded by a spacer;

a movable body placed inside said cavity having a rotational axis; said movable body having a first end and a first movable contact associated with said first end, and said movable body further comprising a first magnet having a permanent magnetization moment;

a switching magnet having a coil, wherein said spacer and said coil together encaging said movable body, and wherein passing a current through said coil generating a switching magnetic field which has a main component primarily perpendicular to said permanent magnetization moment in a region where said switching magnetic field goes through said first magnet, whereby a vector-cross product of said switching magnetic field and said permanent magnetization moment producing a torque on said first magnet and causing said movable body to rotate about said rotational axis;

wherein said switching magnet is controllable to cause said movable body settling in a stable state related to said substrate wherein said stable state is selected from:

a) said first movable contact being in contact with said first stationary contact; or b) said first movable contact being separated from said first stationary contact.

2. An electromechanical relay according to claim 1, wherein said first magnet comprising hard magnetic material.

3. An electromechanical relay according to claim 1, wherein said first magnet comprising soft magnetic material.

4. An electromechanical relay according to claim 1, wherein a second magnet being provided in proximity to said first magnet.

5. An electromechanical relay according to claim 1, wherein said coil being multiple layers of planar circulating conductor traces separated by insulating dielectric films.

6. An electromechanical relay according to claim 1, wherein said coil being multiple windings of a conductor wire coated with an insulating coating.

7. An electromechanical relay, according to claim 1, wherein said spacer comprising a stack of multiple layers of dielectric material on said substrate, and said cavity being a common opening of said stack of multiple layers of dielectric material.

8. An electromechanical relay according to claim 1, wherein a stopper is provided to limit the movement of said movable body.

9. A method of forming an electromechanical relay, comprising providing a substrate, wherein said substrate comprising a first stationary contact;

providing a cavity on said substrate by stacking multiple layers of dielectric material with a common opening;

placing a movable body in said cavity, wherein said movable body having a rotational axis, a first end and a first movable contact associated with said first end, and a first magnet having a permanent magnetization moment;

providing a switching magnet having a coil encaging said movable body, wherein passing a current through said coil generating a switching magnetic field which has a main component primarily perpendicular to said permanent magnetization moment in a region where said switching magnetic field goes through said first magnet, whereby a vector-cross product of said switching magnetic field and said permanent magnetization moment producing a torque on said first magnet and causing said movable body to rotate about rotational axis;

wherein said switching magnet is controllable to cause said movable body settling in a stable state related to said substrate wherein said stable state is selected from:

a) said first movable contact being in contact with said first stationary contact; or b) said first movable contact being separated from said first stationary contact.

10. A method of forming an electromechanical relay according to claim 9, wherein said coil is provided by forming planar circulating conductor traces on said layers of dielectric material and connecting head to tail of adjacent layers of said conductor traces such that said current flows in a common circular direction.

11. A method of forming an electromechanical relay according to claim 9, wherein layers of soft magnetic material is provided to enclose said cavity.

12. A plurality of electromechanical relays formed in accordance with the method of claim 9.

13. A plurality of stacked electromechanical relays formed in accordance with the method of claim 9.

14. An electromechanical relay according to claim 1, wherein said spacer and said coil being formed together as a unitary body.

15. An electromechanical relay according to claim 1, wherein said spacer, said coil and said substrate being formed together as a unitary body.

16. An electromechanical relay according to claim 15, wherein unitary body comprising a plurality of circulating conductive traces and a plurality of ceramic layers.

17. An electromechanical relay according to claim 1, further comprising a cover.

18. An electromechanical relay according to claim 17, wherein said spacer, said coil and said cover being formed together as a unitary body.

19. An electromechanical relay according to claim 17, wherein said cover comprising a soft magnet material.

20. A method of forming an electromechanical relay according to claim 10, wherein said layers of dielectric material comprising a plurality of ceramic sheets, and wherein said ceramic sheets being aligned, stacked, pressed and co-fired together to form a rigid structure.

* * * * *